US007299661B1

(12) United States Patent
Lonati

(10) Patent No.: US 7,299,661 B1
(45) Date of Patent: Nov. 27, 2007

(54) LINEAR KNITTING MACHINE

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 11/717,307

(22) Filed: Mar. 13, 2007

(30) Foreign Application Priority Data

Mar. 16, 2006 (IT) ..... BS2006A000060

(51) Int. Cl.
*D04B 27/08* (2006.01)

(52) U.S. Cl. ..... 66/208

(58) Field of Classification Search ..... 66/203, 66/204, 208, 87, 82 A
See application file for complete search history.

(56) References Cited

U.S. PATENT DOCUMENTS 3,221,520 A * 12/1965 Bassist ..... 66/87
3,460,358 A * 8/1969 Kohl ..... 66/87
3,568,470 A * 3/1971 Kohl ..... 66/207
3,646,782 A * 3/1972 Kohl ..... 66/87
3,665,733 A * 5/1972 Jackson ..... 66/87
3,950,942 A * 4/1976 Namura et al. ..... 66/205
4,267,709 A * 5/1981 Hittel ..... 66/87
4,332,149 A * 6/1982 Mayer ..... 66/87
4,723,424 A 2/1988 Wunner

FOREIGN PATENT DOCUMENTS

DE 3620259 C1 1/1988
WO WO 03/071018 A1 8/2003

* cited by examiner

*Primary Examiner*—Danny Worrell
(74) *Attorney, Agent, or Firm*—Pearne & Gordon LLP

(57) ABSTRACT

The present invention relates to a linear knitting machine comprising: a first (2) and a second (3) needle-bed, each one having at least one bar (4) extending longitudinally along said machine, and at least one row of needles (5) supported by the bar (4); a plurality of thread-guides (10) for arranging at least one respective thread into the needles (5); a motor (11) for moving at least one bar (4) of every needle-bed (2, 3) with a forward and backward motion getting away from/towards the thread-guides (10); and a motion transmitter (12) coupled to the bar (4) of every needle-bed (2, 3) and having at least one rotating element (14) for every needle-bed (2, 3) coupled to the motor (11), and a rod (13) for every needle-bed (2, 3) having a first end (13*a*) stiffly coupled to said bar (4) and a second end (13*b*), opposed to the first one (13*a*), operatively coupled to said rotating element (14) which is provided with at least one cam guide (16).

19 Claims, 5 Drawing Sheets

LINEAR KNITTING MACHINE

FIELD OF THE INVENTION

The present invention relates to a linear knitting machine.

In particular, the present invention relates to a Raschel-type, tricot or similar warp linear knitting machine with single or double needle-bed, commonly also known as Raschel-type warp loom, used for manufacturing knitted items.

BACKGROUND OF THE INVENTION

As is known, Raschel-type linear knitting machines with double needle-bed are provided with two rows of needles, each one being housed in a respective needle-bed and supported by a respective bar. Every needle-bed is further equipped with a series of latches that can be coupled to the needles for so-called "compound" systems, and a series of "stitch-combs" commonly used for preventing the loop from being taken upwards when the needle gets up for discharging the stitch and taking a new thread. Also the series of latches and stitch-combs are supported by respective bars, which are parallel to the needle bars and develop longitudinally along the whole machine.

Needle bars, latch bars and stitch-comb bars are moved synchronously with a forward-backward motion by means of (more or less complex) systems consisting of compound levers suitably arranged (in the form of quadrilaterals), accurately calculated and apt to make the movements they are designed for.

In particular, examples of known machines belonging to this type can be found in documents U.S. Pat. No. 3,221,520, U.S. Pat. No. 3,568,470, U.S. Pat. No. 3,460,358, U.S. Pat. No. 4,332,149, U.S. Pat. No. 3,950,942, DE 3620259 and WO03/071018.

Modern computer-assisted design technologies enables to study accurately the laws of motion of said compound levers with a perfect synchronism between the various fabric-forming elements, starting from the same cam set into motion by a drive shaft.

This system is based on very delicate balances between levers, fulcrums, speeds, accelerations, paths, trajectories and any other factor constituting the mechanism as a whole.

Moreover, said compound levers are designed by analyzing the shape changes of the concerned elements due to working defects, temperature changes and clearances that cannot be avoided in order to operate the knitting machine within the tolerance limits the knitting system can tolerate. As a matter of fact, it should be pointed out that yarns have given limits of mechanical resistance, within which they have to be worked so as to avoid their breaking, stress deformation, bad fabric-formation, which all mean bad quality. Therefore, compound levers are also designed as a function of the type of thread used and of the thread tensioning and feeding values determining the fabric width.

That is why the machine is normally carried out for manufacturing a given item according to the customer's needs. In other words, movements and size of the compound levers are adjusted and calibrated (in textile jargon "sampled") for manufacturing a specific item. However, known machines as described above have great drawbacks.

A first drawback is the little versatility of said machines for manufacturing different items.

As a matter of fact, it should be pointed out that in order to change the layout of the machine so as to obtain movements differing from the predefined ones, very delicate and complex adjustments are carried out, requiring the intervention of personnel having specific instruments and knowledge. For instance, if a yarn whose characteristics differ from the ones previously worked is used, the compound levers should be modified by specialized personnel, changing the path of the elements involved in fabric formation.

As a matter of fact, needles, latches and stitch-combs (which are regarded as consumables) can be replaced by personnel working in the knitwear factory; whereas for other parts, such as for instance a cam replacement, personnel working in the manufacturing firm should intervene, since this involves various disassembling and recalibrating operations.

That is why only a technician working for the firm manufacturing the knitting machine can make changes, if necessary, to said knitting machine trying to simulate and calculate possible implications of the system as a function of the changes required by the customer.

The intervention of specialized personnel is highly expensive because of idle times in which the machine is not used and of costs involving operators' transfer.

A further disadvantage of knitting machines as described above consists in that the mechanisms of movement should necessarily be carried out with highly precise physical elements that show almost inexistent deformations under stress. This means a high accuracy in the choice of materials, shapes, size, working tolerances, which results in high manufacturing costs.

Moreover, it should also be pointed out that the aforesaid compound levers, beyond being quite bulky, require quite large spaces for their movement. Also the positioning of the cams, as is known spaced from one another, and the positioning of the motor involve a particularly large overall size of the whole machine.

A further disadvantage consists in the shape of the rotating shaft associated to the control cams and set into rotation by the motor. Said shaft, which extends on the whole longitudinal development of the machine (needlebeds have a length above 3.5 meters), involves serious problems as far as working, balancing, vibration reduction, assembly are concerned, which problems result exactly from the size of said shaft.

BRIEF SUMMARY OF THE INVENTION

Under these circumstances, the technical task underlying the present invention is to provide a linear knitting machine that is able to substantially obviate the drawbacks referred to above.

Within said technical task, an important aim of the invention is to conceive a linear knitting machine that is versatile and can be easily adapted to different working types, without requiring the intervention of specialized personnel.

Another technical task is to propose a linear knitting machine that is cheap, with small overall size and simple from a structural point of view.

The technical task and the aims referred to above are basically achieved by a linear knitting machine characterized in that it comprises one or more of the technical solutions claimed below.

BRIEF DESCRIPTION OF THE DRAWINGS

The following is a description of a preferred but not exclusive embodiment of a linear knitting machine according to the invention to an indicative and non-limiting purpose, as is shown in the accompanying drawings, in which.

DETAILED DESCRIPTION OF THE PREFERRED EMBODIMENTS OF THE INVENTION

Figure 1:
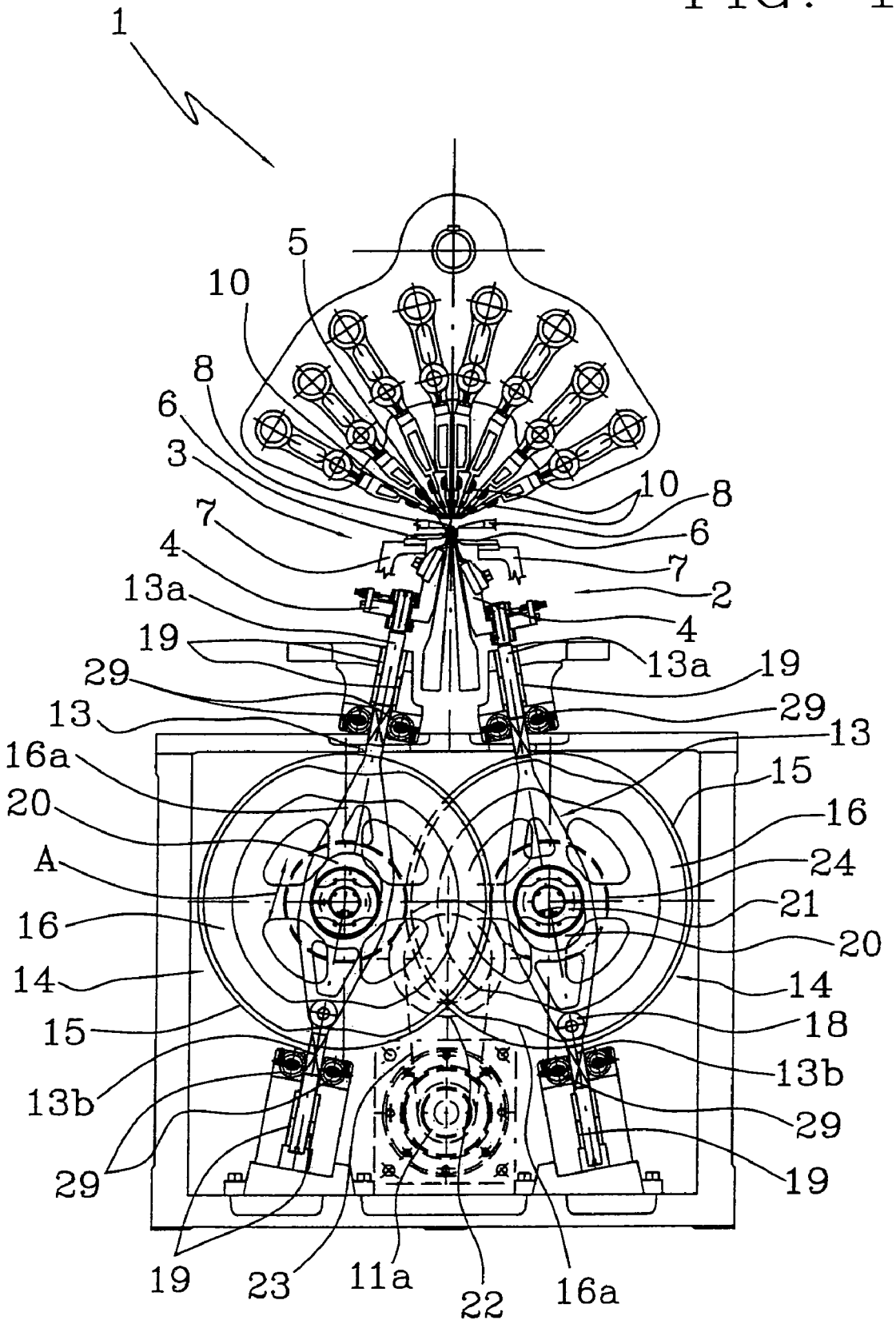
FIG. 1 shows a schematic view in lateral elevation, some parts being removed so as to better show others, of a knitting machine according to the present invention.

With reference to the accompanying drawings, the numeral 1 globally refers to a linear knitting machine according to the present invention.

In particular, the present invention can advantageously apply to Raschel-type linear knitting machines with single or double needle-bed.

The knitting machine 1 comprises a first 2 and a second 3 needle-bed (FIG. 1), which extend longitudinally along said machine 1. Every needle-bed 2, 3 is provided with a bar 4, developing along the whole longitudinal development of the machine 1 and housing a respective row of needles 5.

Advantageously, every needle-bed 2, 3 can be further equipped with a plurality of latches 6 for needles 5 commonly known as "compound" needles, which are known and will not be therefore described in detail in the present disclosure.

The latches 6 operate synchronously with the needles 5 and are supported by a respective bar 7 placed in every needle-bed 2, 3.

Known needles 5 with oscillating latch can also be used. In this case, accordingly, the latch bars 7 are not used in the knitting machine 1.

Moreover, the machine 1 can further be equipped with a plurality of stitch-combs 8, used for preventing the loop made by the machine 1 from being taken upwards when the needle 5 gets up for discharging the stitch and taking a new thread. The stitch-combs 8, which are also known in the specific technical field and will be therefore schematically shown and not described in detail, are supported by a respective bar 9 arranged in every needle-bed 2, 3.

Under these circumstances, the bar 4 holding the needles 5, the bar 7 holding the latches 6 and the bar 9 holding the stitch-combs 8, which are present in every needle-bed 2, 3, are placed side by side and parallel to one another and extend along the whole longitudinal development of the machine 1.

Above said needles 5, a plurality of thread-guides 10 further develops, which are also known and will not be therefore described in further detail, which arrange a series of threads between the needles 5 of the two needle-beds 2, 3. Thus, the combined movement of the thread-guides 10 synchronized with the movement of the needles 5, of the latches 6 and of the stitch-combs 8 results in fabric formation, which is not shown in the accompanying figures for higher clarity.

Figure 2:
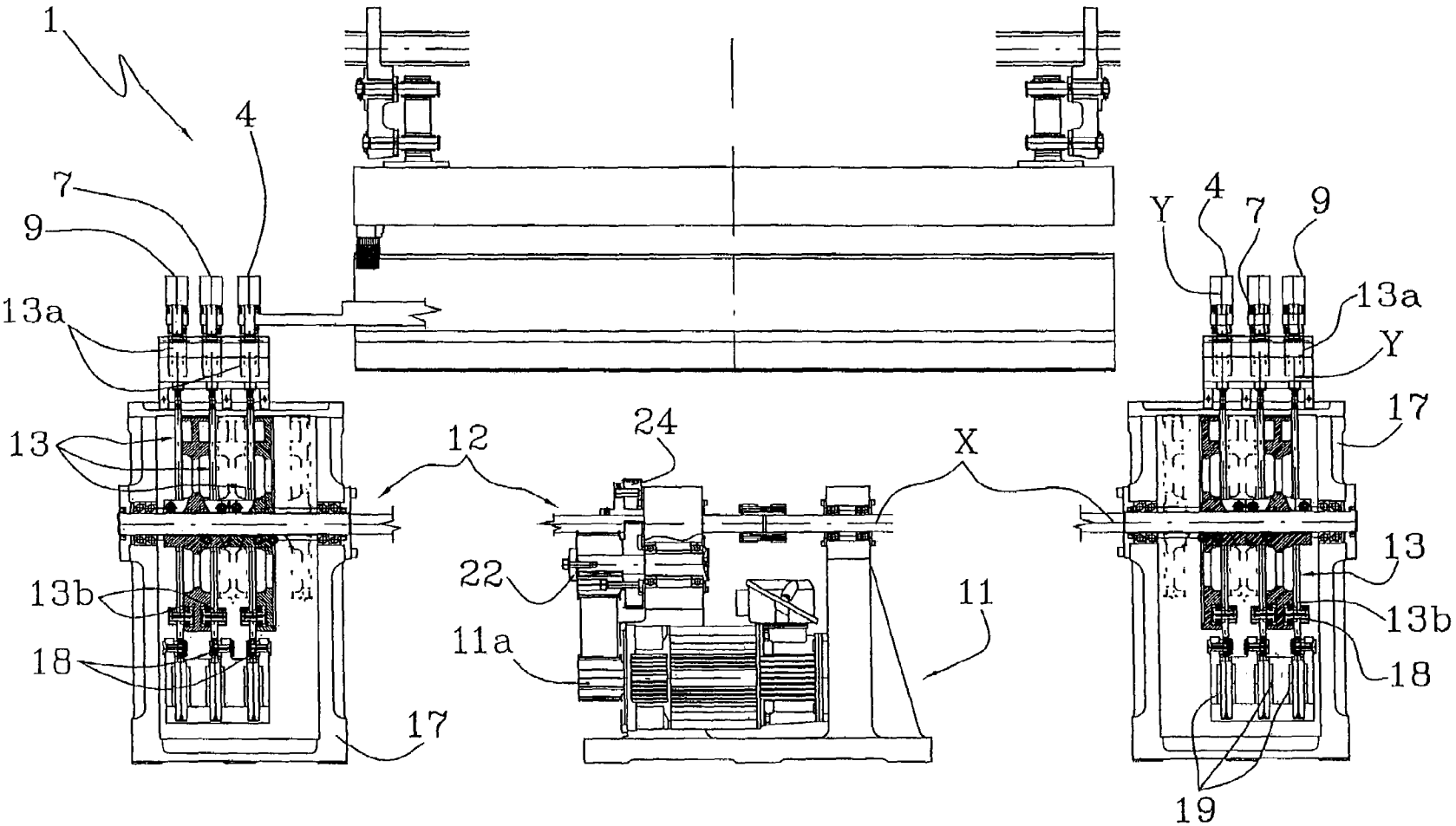
FIG. 2 shows a schematic view in front elevation, some parts being removed so as to better show others, of the knitting machine according to the present invention.
Figure 5:
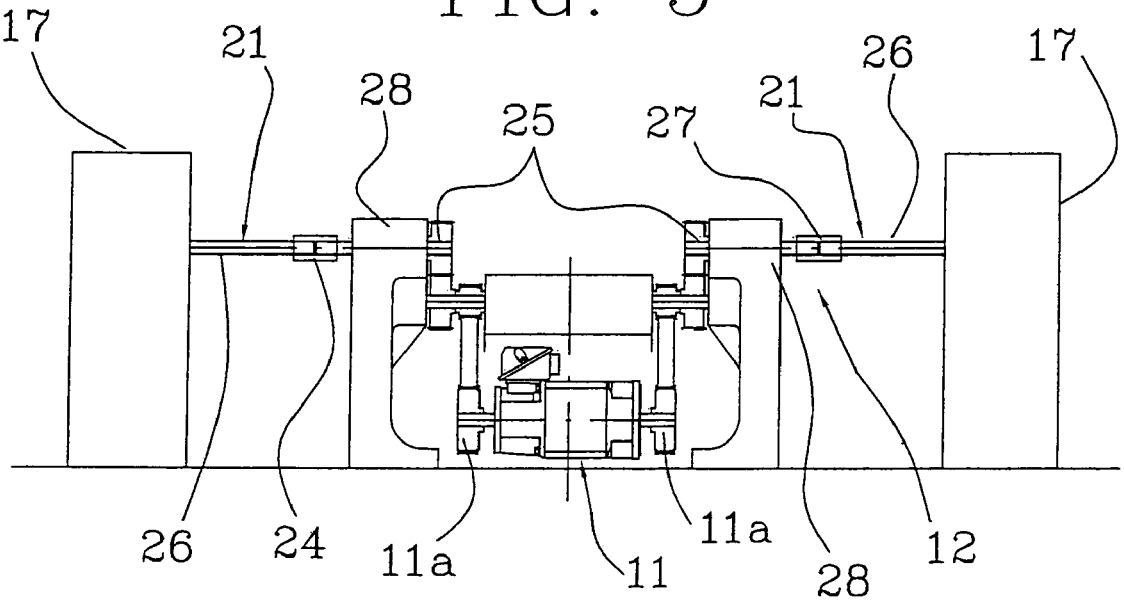
FIG. 5 is a schematic view in lateral elevation of a lower portion of the knitting machine.

With reference to FIGS. 2 and 5, it should be pointed out that the machine 1 is further provided with a motor 11, preferably arranged centrally in the machine 1 as will be described better in the following.

The motor 11 moves the aforesaid bars 4, 7, 9 with a forward-backward motion getting towards/away from said thread-guides 10 for enabling the needles 5 to take or release the thread.

In particular, the motor 11 is connected to the bars 4, 7, 9 through suitable transmission means or motion transmitter 12 comprising stiff rods 13 connected to the bars 4, 7, 9 on respective opposite ends.

In further detail, every bar 4, 7, 9 is stiffly connected to three rods 13, each being positioned on said opposite ends of the respective bar.

As is better shown in FIG. 1 and in FIG. 2, every rod 13 is made up of one stiff body, having an elongated shape and a longitudinal development parallel to a respective direction A of forward-backward movement.

Every rod 13 has a first end 13*a* stiffly engaged to a respective bar 4, 7, 9, and a second end 13*b*, opposite the first one 13*a*, operatively connected to a rotating element 14.

Preferably, as is shown in FIG. 2, every needle-bed 2, 3 is provided with two rotating elements 14 arranged on said opposite ends of the respective bars 4, 7, 9. Thus, every bar 4, 7, 9 is moved by means of the synchronous movement of two rotating elements 14 transmitting motion along direction A to the two rods 13 associated to the ends of the bar.

In detail, every rotating element 14 comprises at least one cam disc 15 (which is referred to in the following as cam) turning around a respective axis X. Advantageously, as is better shown in FIGS. 1 and 4, the rotating element 14 has at least two cams 15 coaxial to one another and mutually engaged.

Still in further detail, the rotating element 14 has a first cam 15*a* equipped with an active surface extending perpendicularly to said axis X and having a cam guide 16 made up of a recess on said active surface. Spaced away from the first cam 15*a*, a second cam 15*b* develops, having two active surfaces opposite to one another and transversal to said axis X. Two respective cam guides 16, also made up of a recess on the respective active surface, develop on the active surfaces of the second cam 15*b*.

Figure 4:
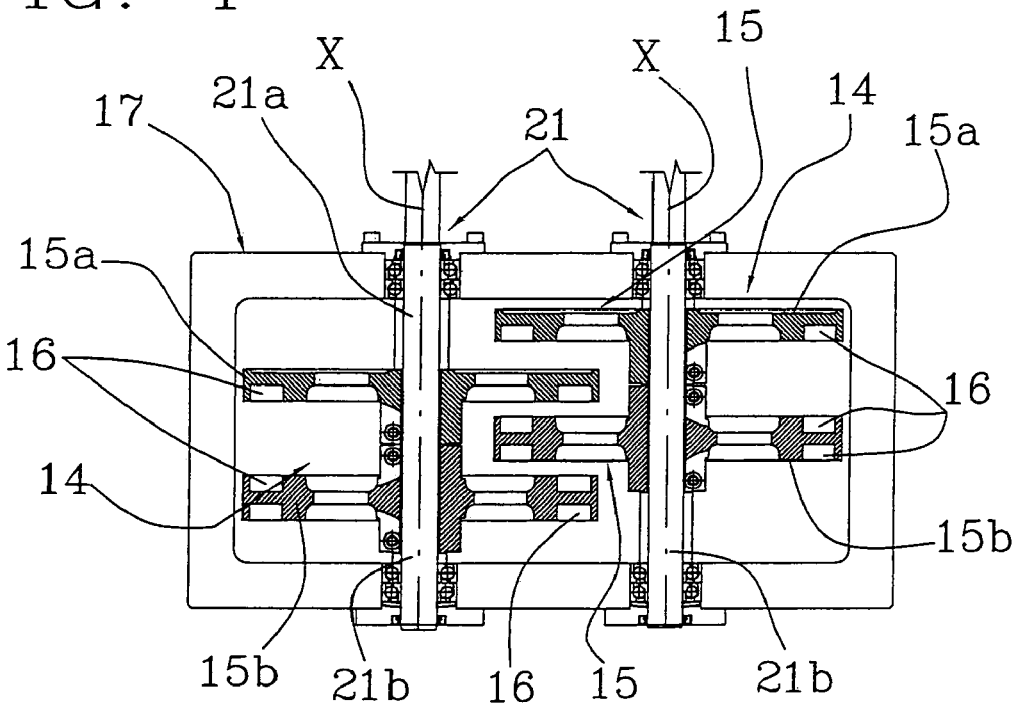
FIG. 4 is a plan view of another constructive detail of the knitting machine.

Under these circumstances, it should be pointed out that for every rotating element 14 three cam guides 16 are provided for, two of them being placed in the second cam 15*b* and one in the first cam 15*a*, respectively (FIG. 4).

Preferably, every cam guide 16 has a basically circular development and extends around the axis of rotation X of the respective cam 15 according to a trajectory predefined as a function of the movement to be transmitted to said bars 4, 7, 9.

Advantageously, the machine 1 further comprises two box-shaped bodies 16, each of them being arranged below an end of the respective bars 4, 7, 9.

Every box-shaped body 17 is made up of a chamber containing two rotating elements 14 adjacent to one another, each of them belonging to a respective needle-bed 2, 3.

Figure 3B:
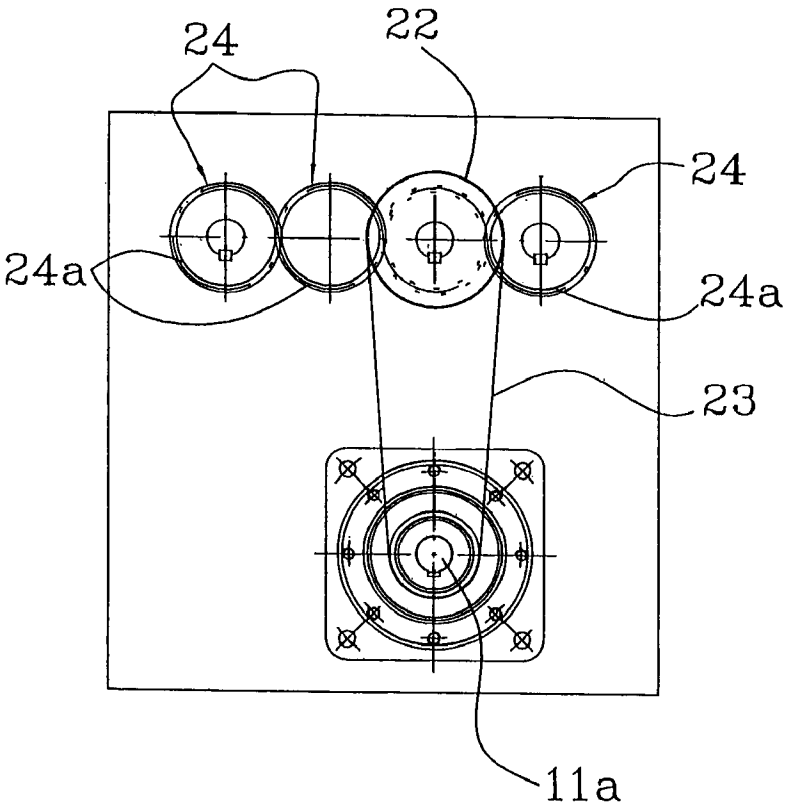
FIG. 3B is a view in lateral elevation of a constructive detail of the machine shown in FIGS. 1 and 2 according to a second execution variant.
Figure 3A:
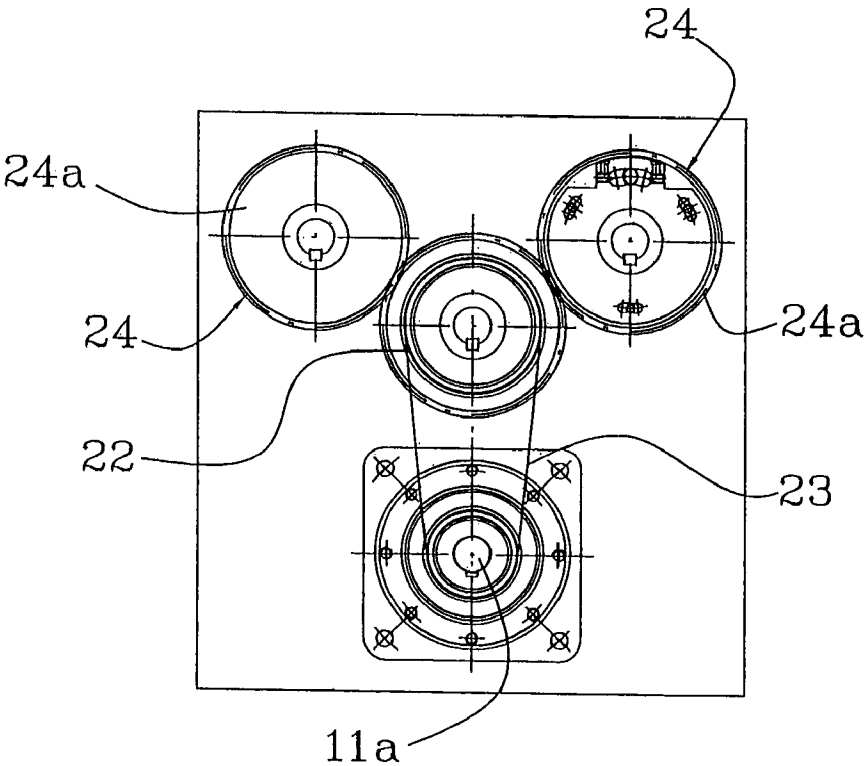
FIG. 3A is a view in lateral elevation of a constructive detail of the machine shown in FIGS. 1 and 2 according to a first execution variant.

As is shown in FIG. 3A, the rotating elements 14 contained in every box-shaped body 17 turn in the same directions around respective axes X parallel to one another, and are immersed in a lubricating substance, such as oil for instance, so as to reduce the frictions of the rotating elements 14 during the movement thereof. Alternatively, by varying the number of gears, said rotating elements 14 contained in every box-shaped body 17 can turn in the opposite direction, as is shown in FIG. 3B.

With particular reference to FIG. 4, it should also be pointed out that one of the cams 15*a*, 15*b* of a respective rotating element 14 is housed between the two cams 15*a*, 15*b* of the adjacent rotating element 14. In other words, inside every box-shaped body 17 the two rotating elements 14 are adjacent and offset so that the respective cams 15 can get into one another resulting in highly reduced overall sizes.

As is shown in FIG. 1, the second end 13*b* of every rod 13 is provided with a roller 18 inserted slidingly into a respective cam guide 16. Taking into consideration a single needle-bed 2, 3, it should be pointed out that the three rods 13 associated to the three bars 4, 7, 9 on a respective end are associated to a rotating element 14 that is equipped, as described above, with three cam guides 16 for housing said rollers 18.

Thus, during the rotation around axis X of every rotating element 14, the rollers 18 inserted into the cam guides 16 slide along a path defined by the shape of said guide 16. On wave-shaped portions 16*a* of said guide 16, the roller is moved by determining its shift along direction A of the rod 13 with the forward-backward motion.

Moreover, every rod 13 is associated to respective longitudinal guide means or guides 19, 29. Said guide means or guides 19, 29 comprise guide bushings 19 designed to guide the rod 13 in its forward-backward longitudinal movement according to the direction of movement A, and guide bearings 29 for preventing said rods 13 from rotating around an axis Y, which is perpendicular to the axis of rotation of the elements 14. In particular, every rod 13 is suitably worked so that the guide bearings 29 oppose the efforts tending to make it turn around axis Y.

The bushings 19 are made up of hollow cylindrical elements into which the ends 13*a*, 13*b* of every rod 13 are inserted. The bushings 19 engage the respective rods 13 for enabling the movement of the latter only in the direction of movement A.

It should also be pointed out that the rods 13 are partially housed inside the box-shaped body 17 so that the respective rollers 18 are completely immersed in the lubricating liquid.

In a preferred embodiment of the invention, six rods are inserted into every box-shaped body 17, three of them being associated to a rotating element 14 belonging to the first needle-bed 2 and three of them being associated to a rotating element 14 belonging to the second needle-bed 3.

In other solutions of embodiment, every rotating element 14 of every needle-bed 2, 3 can be associated to two, four or more rods.

Moreover, every rod 13 is further equipped with a recess 20 inside which develops a rotating shaft 21 fitted onto a respective rotating element 14 and belonging to said transmission means 12.

In particular, as is better shown in FIG. 1, every rod 13 develops diametrically beside the active surface in which the respective cam guide 16 is obtained. In this situation, the recess 20 placed between the first 13*a* and the second 13*b* end of every rod 13 gets through the center of the respective cam 15.

The recess 20 is further basically elliptical in shape so as to enable the sliding along direction A of the rod 13 around said shaft 21.

In particular, the transmission means include four rotating shafts 21, each of them having a first end 21*a* associated to the motor 11 and a second end 21*b* opposite the first one 21*a* and fitted onto a respective rotating element 14.

The transmission means 12 are further provided with a rotating pulley 22 associated to the motor 11 by means of a toothed belt 23 engaged to a rotating pin 11*a* of said motor 11.

In particular, the pulley 22 is associated to a toothed wheel turning around a respective axis of rotation parallel to the longitudinal development of the machine 1 (FIGS. 2, 3A, 3B).

The gear associated to the pulley 22 is further engaged to two connection elements 24 arranged on the sides of the gear associated to said pulley and fitted onto the first end 21*a* of respective shafts 21.

In particular, the connection elements 24 are made up of gears 24 associated on opposite sides of the gear associated to the pulley 22 for rotating in respective directions.

Every gear 24*a* is arranged in a respective needle-bed 2, 3 and is associated to the first ends 21*a* of two respective shafts 21 connected to the rotating elements 14 of said needle-bed 2, 3.

As mentioned above, the motor 11 is arranged between the ends of the bars 4, 7, 9 in a basically median position with respect to the box-shaped bodies 17 (FIGS. 2 and 5).

Under these circumstances, the shafts 21 of every needle-bed 2, 3 are both fitted onto opposite ends of the same gear 24*a* and develop in an opposite direction with respect to the motor 11 and to the corresponding box-shaped body 17.

Advantageously, every shaft 21 connected to the respective rotating element 14 comprises a first portion 25 near the motor 11 and associated to the respective connection element 24, and a second portion 26 associated to the rotating element 14.

In other words, every shaft 21 is made up of two portions 25, 26 joined to one another by means of a connection joint 27. Thus, the joint 27 keeps said portions engaged and coaxial to one another.

Preferably, as shown in FIG. 5, the first portion 25 of every shaft 21 is supported by a suitable support 28 resting onto the machine body.

Thus, the whole shaft 21 cannot get does not risk to became flexed by applying an excessive effort onto said connection joint 27.

During operation, the motor 11 sets into rotation, by means of the belt 23, the pulley 22 and thus also the connection elements 24 connected thereto.

Thus, the two shafts 21 of every needle-bed 2, 3 transmit the rotation to the respective rotating elements 14 around axis X.

It should be pointed out that the shafts 21 associated to the two rotating elements 14 housed within a respective box-shaped body 17 rotate in the same directions (FIG. 3A). By adding a gear, the same shafts 21 can rotate in opposite directions (FIG. 3B). Accordingly, also the rotating elements 14 belonging to the two needle-beds and housed within a respective body 17 are set into rotation in the same or in opposite directions. As a result of the rotation of the cams 15, the roller 18 slides within the respective guide 16 and cannot slide in a transversal direction with respect to the longitudinal development of the respective rod 13. As a matter of fact, the guide bearings 29 enable the movement of the rod 13 only in said direction A and prevent, as described above, the rotation of the rods 13 along axis Y.

When the roller 18 meets a wave-shaped portion 16*a* of the guide 16, said roller is moved in direction A so that the whole rod 13 and therefore the respective bar 4, 7, 9 are shifted.

Under these circumstances, it should be pointed out that the rotation of the rotating elements 14 of every needle-bed 2, 3 occurs coordinately so as to move in a balanced manner the respective bars 4, 7, 9 and, accordingly, the needles 5, the latches 6 and the stitch-combs 8 associated thereto.

It should also be pointed out that the cam guides 16 obtained in every cam 15 can have any shape so as to obtain differentiated movements of the rods 13 associated thereto.

Figure 7:
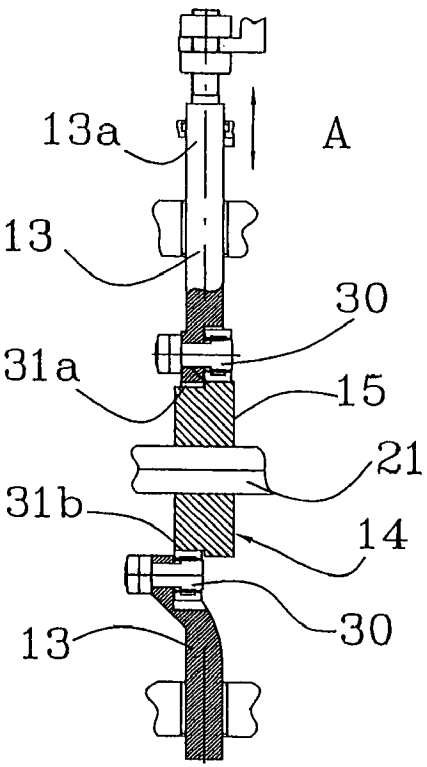
FIG. 7 shows a section of FIG. 6 along lines VII-VII.
Figure 6:
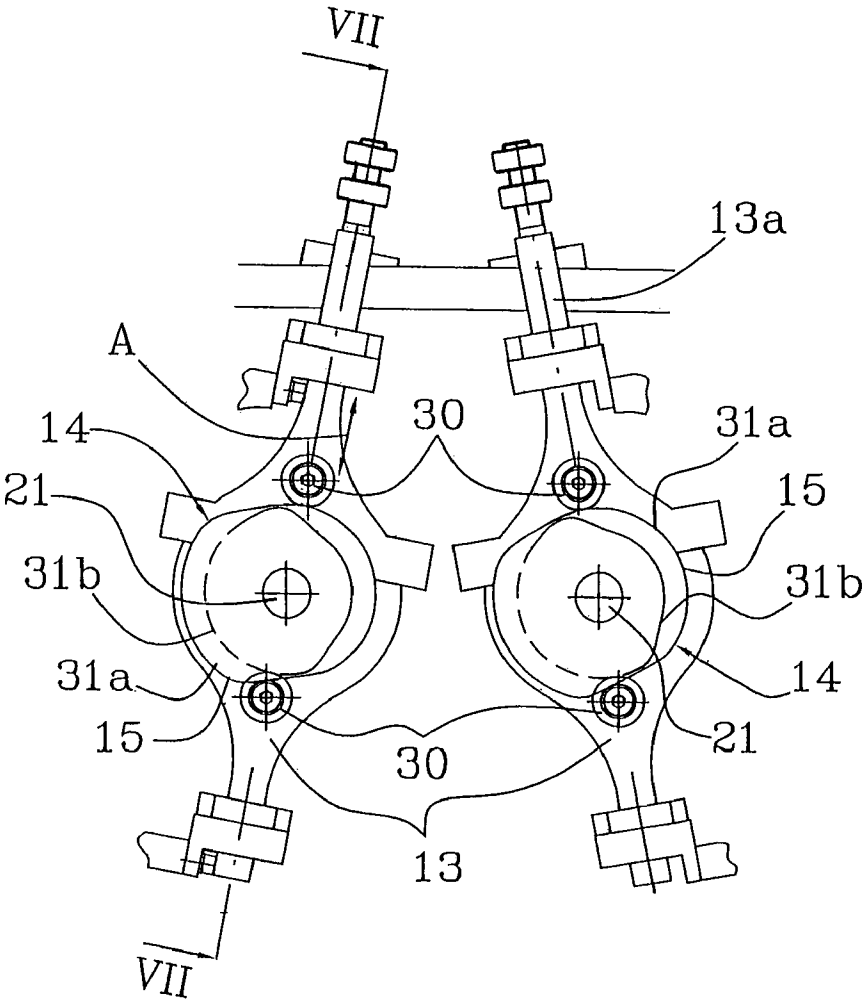
FIG. 6 shows a schematic view in lateral elevation, some parts being removed so as to better show others, of a knitting machine according to an alternative embodiment with respect to the one shown in FIG. 1.

Another embodiment of the knitting machine 1, shown in FIGS. 6 and 7, can be carried-out by using double profile cams 15 moving the rods 13 by means of two movement bearings 30 associated thereto. Said movement bearings 30 slide externally on two tracks 31*a*, 31*b* obtained on said cams 15.

The invention achieves important advantages.

First of all, the machine is very simple from a structural point of view, especially as far as the rod moving elements are concerned.

As a matter of fact, motion is transmitted by the rotating element only by means of the stiff rod and there are no quadrilaterals or other complicated compound levers. Advantageously, in order to change the movement of the bars, the cams having said guide cams causing the movement of said bars are replaced.

In other words, depending on the type of thread, on the type of item or on an error in the movement of a bar detected during the operation of the knitting machine, cams having guides adapted to the specific purpose are carried out and those in use are replaced.

Thus, after carrying out cams with suitable guides, several variations in bar movement are provided.

The simple construction of the rods enables cam replacement also by a non-specialized operator, who does not have to execute any adjustment on the machine. Acting upon the box-shaped body, the operator can easily disassemble the cams and reassemble replacement cams. Advantageously, the intervention of specialized personnel is avoided, which enables to save money.

Moreover, every cam can be associated to a type of item or yarn to be worked, stored and then used whenever a given item has to be manufactured.

Another important advantage of the present invention is the simple structure, the small overall size and, therefore, the low manufacturing costs.

As a matter of fact, as referred to above, the rotating elements can get one into the other and enable to save much space. As a consequence, also the box-shaped body will be small-sized. Moreover, the rods are simply made up of stiff elements, carried out as one piece and not subject to particular adjustments and/or jointed movements.

It should further be pointed out that the rotating shafts are slim in structure since they are made up of separate portions that are much shorter than the longitudinal development of the whole machine. Therefore, problems involving assembly and the excessive weight of the shafts are eliminated.

Furthermore, the joints eliminate torsional phenomena that might occur with very long shafts, involving a different rotation of the elements contained in the same body, which rotate with an angular offset due to said torsion of the shaft.

Moreover, as referred to above, the shafts of the first needle-bed, and therefore also the elements, can rotate in the same direction or in an opposite direction with respect to the one of the second needle-bed.

As a consequence, in case of rotation in opposite direction, the masses in movement are counterbalanced, thus avoiding the accumulation of energy due to unavoidable vibrations. Said energy is therefore advantageously dispersed thanks to the counter-rotation of the shafts.

The invention claimed is:

1. A warp linear knitting machine comprising:

a first (2) and a second (3) needle-bed, each one having at least one bar (4) extending longitudinally along said machine, and at least one row of needles (5) supported by said bar (4);

a plurality of thread-guides (10) for arranging at least one respective thread into said needles (5);

a motor (11) for moving said at least one bar (4) of every needle-bed (2, 3) with a forward and backward motion getting away from/towards the thread-guides (10); and a motion transmitter (12) coupled to said at least one bar (4) of every needle-bed (2, 3) and having at least one rotating element (14) for every needle-bed (2, 3) coupled to the motor (11);

characterized in that said motion transmitter (12) further comprises at least one rod (13) for every needle-bed (2, 3) having a first end (13*a*) stiffly coupled to said bar (4) and a second end (13*b*), opposed to the first one (13*a*), operatively coupled to said rotating element (14) which is provided with at least one cam guide (16).

2. The machine according to claim 1, characterized in that said rod (13) of every needle-bed (2, 3) is stiff and has a longitudinal development basically parallel to a forward-backward direction of movement (A) of said rod (13).

3. The machine according to claim 1, characterized in that said motion transmitter (12) further comprises: a transmission pulley (22) coupled to a gear and to said motor (11); at least one connection element (24) for every needle-bed (2, 3), coupled to said gear of said pulley (22) for rotating around a respective axis; and at least one rotating shaft (21) having a first end (21*a*) fitted onto the connection element (24), and a second end (21*b*) opposed to the first one (21*a*) interference fitted onto the rotating element (14).

4. The machine according to claim 1, characterized in that said rotating element (14) comprises at least one cam disc (15) turning around a respective axis (X), said at least one cam guide (16) being defined on said cam disc (15).

5. The machine according to claim 4, characterized in that said second end (13*b*) of the rod (13) comprises a roller (18) sliding inside said cam guide (16) obtained in said cam disc (15); said cam guide (16) having a shape developing around the axis of rotation (X) of said cam disc (15).

6. The machine according to claim 4, characterized in that said cam disc (15) has at least two cam guides (16) so as to define two discrete tracks (31*a*, 31*b*), and in that said second end (13*b*) of the rod (13) comprises at least two movement bearings (30) for sliding in each of said two tracks (31*a*, 31*b*), respectively.

7. The machine according to claim 1, characterized in that every needle-bed (2, 3) further comprises at least one bar (9) holding stitch-combs (8) basically parallel to the bar (4) supporting said row of needles (5); each bar (4, 9) being stiffly coupled to at least one respective rod (13).

8. The machine according to claim 1, characterized in that every needle-bed (2, 3) further comprises at least one bar (7) holding latches (6) basically parallel to the bar (4) supporting said row of needles (5); each bar (4, 7) being stiffly coupled to at least one respective rod (13).

9. The machine according to claim 4, characterized in that every rotating element (14) includes at least two cam discs (15) coaxial to one another and fitted onto the respective rotating shaft (21).

10. The machine according to claim 1, characterized in that every bar (4, 7, 9) of every needle-bed (2, 3) is stiffly coupled to two respective rods (13) housed on opposite ends of said bar (4, 7, 9).

11. The machine according to claim 10, characterized in that it comprises two rotating elements (14) for every needle-bed (2, 3), each of them being arranged on opposite ends of said bars (4, 7, 9) so as to be coupled to the rods (13) engaged to the bar (7) holding the latches (6), to the bar (9) holding the stitch-combs (8) and to the bar (4) supporting said row of needles (5), respectively.

12. The machine according to claim 11, characterized in that it further comprises two box-shaped bodies (17) arranged on respective opposite ends of said bars (4, 7, 9) and each one containing at least two rotating elements (14), each of them being coupled to a respective needle-bed (2, 3).

13. The machine according to claim 12, characterized in that said connection elements (24) include respective gears (24*a*) engaged on opposite sides of said gear of said pulley (22) for rotating in opposite directions.

14. The machine according to claim 12, characterized in that said rotating elements (14) housed within a respective box-shaped body (17) are adjacent to one another for turning around corresponding parallel axes (X) and in the same or opposite directions; every rotating element (14) having a first (15*a*) and a second (15*b*) cam disc coaxial to and spaced away from one another, at least one of said cam discs (15*a*, 15*b*) of a rotating element (14) being housed between two cam discs (15*a*, 15*b*) of the adjacent rotating element (14).

15. The machine according to claim 14, characterized in that said first cam disc (15*a*) comprises an active surface facing said second cam disc (15*b*) and having said cam guide (16); said second cam disc (15*b*) having two opposite active surfaces, each of them having a cam guide (16).

16. The machine according to claim 15, characterized in that said cam guide (16) comprises a recess on the corresponding active surface of a respective cam disc (15*a*, 15*b*).

17. The machine according to claim 16, characterized in that said motor (11) is arranged between the opposite ends of said bars (4, 7, 9); said motion transmitter (12) including two rotating shafts (21) for every needle-bed (2, 3) extending on opposite sides of the motor (11) and each of them being coupled to a rotating element (14) arranged in the respective box-shaped body (17).

18. The machine according to claim 17, characterized in that every shaft (21) comprises: at least one first portion (25) near the motor (11) and engaged to a respective connection element (24), and a second portion (26) coupled to the respective rotating element (14); and a connection joint (27) for joining said first and second portion (25, 26) coaxially to one another.

19. The machine according to claim 1, characterized in that it further comprises a guide (19, 29) operatively acting upon said rods (13) for preventing said rods (13) from deviating from the direction of movement (A).

* * * * *

UNITED STATES PATENT AND TRADEMARK OFFICE

CERTIFICATE OF CORRECTION

PATENT NO. : 7,299,661 B2
APPLICATION NO. : 11/717307
DATED : November 27, 2007
INVENTOR(S) : Tiberio Lonati It is certified that error appears in the above-identified patent and that said Letters Patent is hereby corrected as shown below:

On the Title Page, item (10) should read -- US 7,299,661 B2 --.

On the Title Page, insert item (65) after (22) is "US2007-0214844-A1, published on September 20, 2007" to read -- (65) Priority Publication Data: US 2007/0214844 A1 --.

Signed and Sealed this

Eighteenth Day of August, 2009

David J. Kappos

David J. Kappos
*Director of the United States Patent and Trademark Office*